US008375497B1

(12) United States Patent
Fitzen

(10) Patent No.: US 8,375,497 B1
(45) Date of Patent: Feb. 19, 2013

(54) LEAF COLLECTION TRAPS FOR POOL VACUUMS

(75) Inventor: Steven C. Fitzen, Las Vegas, NV (US)

(73) Assignee: Steven C. Fitzen, Las Vegas, NV (US)

( * ) Notice: Subject to any disclaimer, the term of this patent is extended or adjusted under 35 U.S.C. 154(b) by 495 days.

(21) Appl. No.: 12/781,718

(22) Filed: May 17, 2010

Related U.S. Application Data

(60) Provisional application No. 61/178,715, filed on May 15, 2009.

(51) Int. Cl.
*A47L 7/00* (2006.01)
*E04H 4/16* (2006.01)

(52) U.S. Cl. ..... 15/1.7; 15/415.1; 15/418

(58) Field of Classification Search .. 15/1.7; *E04H 4/16*
See application file for complete search history.

(56) References Cited

U.S. PATENT DOCUMENTS 3,243,830 A 4/1966 Conrad
3,949,442 A * 4/1976 Chandler ..... 15/1.7
4,835,810 A 6/1989 Hugo

* cited by examiner

*Primary Examiner* — Monica Carter
*Assistant Examiner* — Stephanie N Berry
(74) *Attorney, Agent, or Firm* — Kenehan & Lambertsen, Ltd; John C Lambertsen

(57) ABSTRACT

A multiple planar surface baffle provides enhanced water flow and leaf capture benefits for pool/spa vacuum heads. A first planar surface is a support plate for attachment to a vacuum head at open segment locations between adjacent support wheels along both front and back edges of the vacuum head. The second and third planar surfaces are displaced at angles relative to one-another, and relative to the support plate. The second and third planar surfaces cooperate when attached to the vacuum head to provide a larger capture opening, to minimize displacement flow of water over the vacuum head, and to provide a water profile that induces enhanced downward water currents to better entrain leaves and other low density debris.

11 Claims, 5 Drawing Sheets

LEAF COLLECTION TRAPS FOR POOL VACUUMS

RELATED APPLICATIONS

The present application claims priority under 35 U.S.C. §119(e) to U.S. Provisional Patent Application, Ser. No. 61/178,715, filed May 15, 2009, which is incorporated by reference herein.

BACKGROUND OF THE INVENTION

1. Field of the Invention

The present invention relates to cleaning tools for cleaning submerged surfaces, and more particularly, to vacuum heads for cleaning the submerged surfaces of swimming pools and spas. More specifically, the present invention relates to baffles that are attached to such vacuum heads at multiple locations, directing water flow in manners that better direct and entrain low density debris, enhancing the cleaning efficiency of the vacuum head.

2. Description of the Related Art

Summer windstorms—and breezes throughout the swimming pool season, result in the placement of leaves, dust, and other debris into the pool. Pool re-circulating filters remove the majority of small suspended materials. The same re-circulating pump is used as part of a vacuum system to remove the larger materials that are deposited on the pool bottom and sides.

A flexible hose attached to the skimmer intake at one end extends to a vacuum head at the other; upon activation of the pool pump the latter is maneuvered over the pool side and bottom surfaces to retrieve water-soaked leaves, branches, and grass—and other low density materials found resting thereon, resulting in water entrainment that carries the debris through the flexible hose for return to the pool pump. A pre-filter is usually employed at an in-line position along the flexible hose, separating out the larger particles to prevent premature fouling of the pool filter, which is designed for use in separating out the finer particles of soil and silt from the re-circulating pool water.

Commercial pool cleaning services, which typically clean between 20-40 pools a day, often employ a separate water circulation and filtering system—that does not utilize the pool pump or filters. However, the efficiency of cleaning is closely tied to the efficiency by which the vacuum head retrieves these low density materials. Possessing almost neutral buoyancy, these low density materials are easily diverted by currents resulting from the passage of the vacuum head through the water or such currents as result from the uneven suction velocity gradients caused by the vacuum head during operation.

One of the more popular vacuum heads for the commercial market is marketed under the name PROVAC® brand by Pentair Water Commercial and Aquatics (part of Pentair Water Pool and Spa, a division of Pentair, Inc., Minneapolis, Minn.). Vacuum head Model No. 214 is a 14-inch flexible vacuum head that provides a suction chamber designed to normalize the suction along the length of the head and on both lateral sides.

Vacuum head Model No. 214 also includes flexible strips that are attached to the vacuum head bottom along both front and back edges to guide debris into the suction chamber. Two different sizes of flexible strips are provided; the longer-legged strips extend a greater distance from the vacuum head bottom surface and are appropriate for collecting sand, silt, and other fine debris. Shorter-legged strips are also provided, and are intended for enhancing the pickup of leaves and other larger, low density materials.

Although the shorter-legged strips provide a larger vertical gap between the vacuum head bottom and the surface of the pool, the larger debris often-times has difficulty passing through this opening—with multiple passes frequently required. Such additional effort slows the process of cleaning, requiring professional cleaning staff to spend greater amounts of time than would otherwise be necessary if vacuum head pickup were more efficient.

This problem of debris entry is exacerbated in drier climates, where plant leaves are resistant to the passage of water. Such leaves are considerably less able to become water-soaked and flexible, making it difficult for the vacuum head to pick up such leaves in a single pass. A need exists to enhance the entrainment of leaves and other larger, low density materials in vacuum heads used to clean the bottom and side surfaces of swimming pools and spas.

DISCLOSURE OF THE INVENTION

A water flow enhancement and entrainment guide in accordance with aspects of embodiments of the present invention includes three distinct planar surfaces, the first to engage with a vacuum head, the second and third forming deflection bends to provide a larger capture opening, minimize the displacement flow of water over the top of the vacuum head, and providing a water profile that induces enhanced downward water currents to direct leaves and other low density debris under the bottom edges of the vacuum head, for better entrainment and evacuation.

In a further aspect of the present invention a water flow enhancement guide for a pool and spa vacuum head, the vacuum head having an elongate unitary flexible body having a substantially flat bottom surface and lengthwise front and rear edges extending along a width of the body, a plurality of support wheels carried by the body forwardly of the front and rearward of the rear body edges, adjacent pairs of support wheels separated and defining an open segment along said front and rear body edges, said open segment corresponding to a flex panel formed in the body, and a suction port through the body substantially centrally of the length and width thereof, and including means carried on an upper body surface for connecting a pool water suction line to the suction port, said water flow enhancement guide comprising: a baffle having a first end adapted to be received by the open segment of the body and mate with the flex panel of the body, and a second end displaced in an angle.

In a still further aspect of the present invention a device to enhance the flow of water between support wheels of a vacuum head, the vacuum head having an elongate body with a bottom surface and front and rear edges, a plurality of the support wheels spaced apart along both the front and rear edges with a plurality of flex panels, each extending between an adjacent pair of support wheels, said device to enhance the flow of water comprising: a baffle having three distinct planar surfaces, said first planar surface comprising a support plate adapted to attach to an open segment of the flex panel, said open segment adjacent either said front or said rear edge, said second planar surface comprises a rear deflector plate and extends from an initial deflector bend adjacent said support plate to an apex bend, and said third planar surface comprises an inclined attack plate and extends from said apex bend to a terminus of said baffle.

It is to be understood that the invention is not limited in its application to the details of construction and the arrangement of components described hereinafter and illustrated in the drawing figures. Those skilled in the art will recognize that various modifications can be made without departing from the scope of the invention.

BRIEF DESCRIPTION OF THE DRAWINGS

Embodiments in accordance with the present invention are described below in connection with the accompanying drawing figures.

DETAILED DESCRIPTION OF THE PREFERRED EMBODIMENTS

Figure 1:
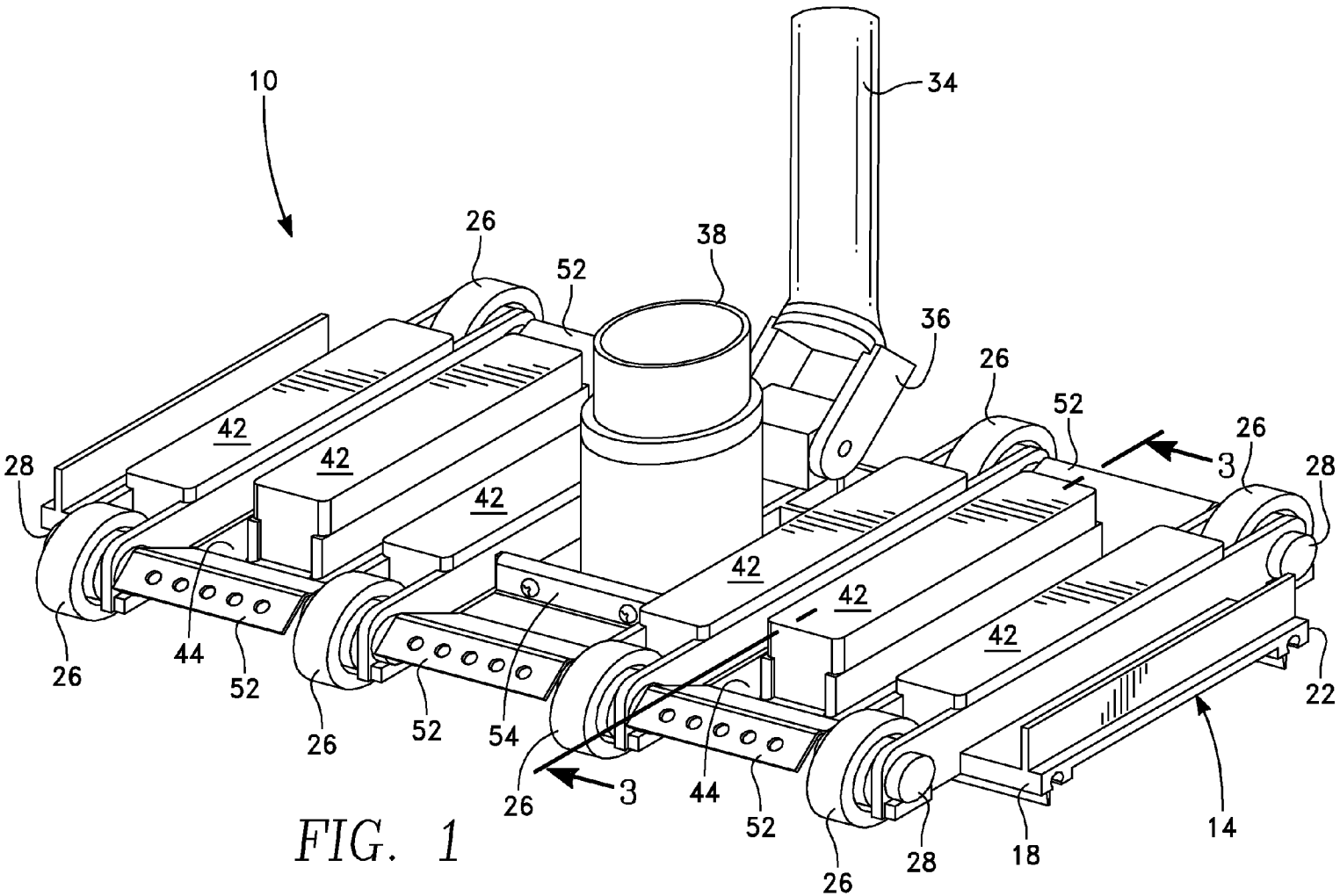
FIG. 1 is a perspective view of a vacuum head in accordance with the present invention.

Reference is now made to the drawings wherein like numerals refer to like parts throughout. In FIG. 1, a vacuum head 10 resembling the Pentair Model No. 214 (discussed previously) consists of an elongate, flexible flat body 14 having a front edge 18 and a rear edge 22, with a plurality of support wheels 26 attached to the flat body 14 at spaced locations along both the front and rear edges 18, 22. A plurality of axle caps 28 are attached to each side of each of the plurality of support wheels 26, providing additional lateral stability and support.

An operating pole 34 extends upwardly from a journaled connection 36 to the flat body 14, and is utilized by a pool cleaner (not shown) to guide the vacuum head 10 during the cleaning of pool surfaces. A vacuum hose connector 38 projects upwardly from the mid-section of the flat body 14 adjacent to the operating pole 34, and receives a hose (not shown in the drawings) that is attached to and in fluid communication with a swimming pool (or spa) pump and filtration system (not shown in the drawings). During cleaning the suction created by operation of pool pump and filtration system causes water to be drawn through the vacuum head 10, which is designed to collect and entrain debris in the flowing water. Upon discharge through the vacuum hose connector 38, the water and entrained debris flow through the hose and into the pool pump and filtration system, before being returned for discharge back to the pool.

Fabricated out of a low-density plastic, the vacuum head 10 is provided a plurality of weight housings 42 in spaced-apart relation, with the weights contained therein providing sufficient mass to the vacuum head 10 to obtain an overall density for the vacuum head 10 that is substantially greater than 1.0. As so weighted, the vacuum head 10 is able to maintain sufficient pressure against pool surfaces to form the desired water flow currents that are used to entrain and remove pool debris.

The support wheels 26 and the weight housings 42 are in substantial longitudinal alignment with one another. A plurality of flex panels 44 extend between and separate each of the pairs of support wheels 26 and weight housings 42, the flex panels 44 lending additional longitudinal flexibility to the flat body 14.

The flex panels 44 also create open segments along both the front and rear edges 18, 22 of the flat body 14 where water can flow unimpaired over and underneath the vacuum head 10, increasing the strength and velocity of water flowing into the vacuum head 10. A plurality of perforated baffles 52 are attached to the flat body 14, one perforated baffle 52 for each open segment, front and back edges 18, 22, of the plurality of flex panels 44, as well as one perforated baffle 52 for the front edge of the hose connector support panel 54.

Figure 2:
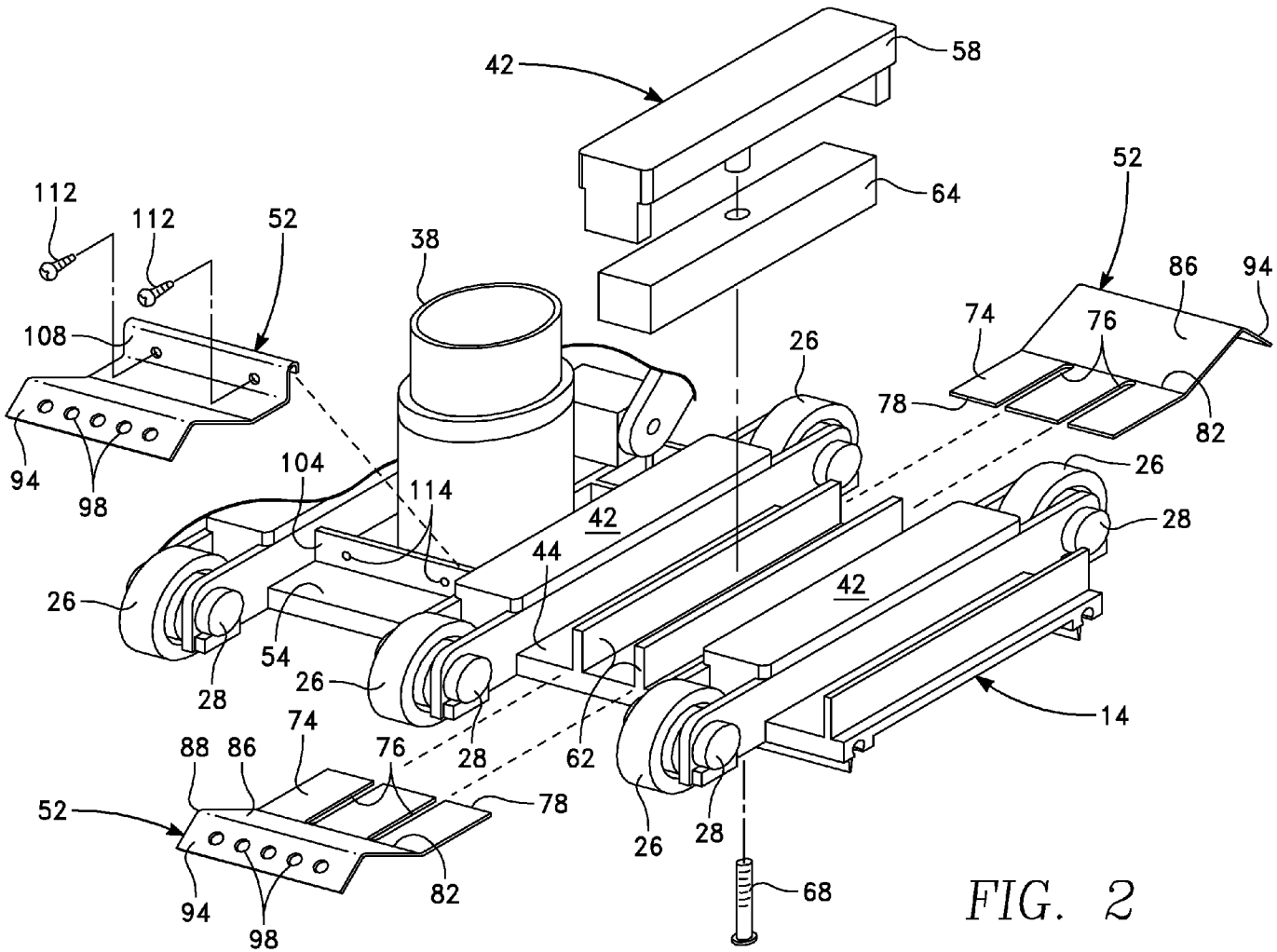
FIG. 2 is an exploded, partial perspective view of a vacuum head, similar to FIG. 1, in accordance with the present invention.

The manner in which the plurality of perforated baffles 52 are attached to the vacuum head 10 is best described with reference to FIG. 2. The weight housing 42 consists of an outer cap 58 that is received and rests upon a pair of parallel support walls 62 that are formed in and project from the flat body 14. A weight 64 is received within the support walls 62 and within the outer cap 58, which is secured to the flat body 14 using a weight housing fastener 68.

The support walls 62 and attached outer cap 58 are advantageously utilized to seat and retain several of the perforated baffles 52—those having three distinct planar surfaces. A first one of those surfaces forms a support plate 74 having a pair of receiving slots 76 formed therein and extending from a back edge 78 of the support plate 74 to an initial deflector bend 82.

The receiving slots 76 are substantially parallel and dimensionally correspond to the support walls 62, upon which they are slidably received when the support plate 74 is mounted upon the flex panel 44. Upon securement of the outer cap 58 to the flat body 14 a downward force is applied to the support plate 74, resisting its removal from an attached location on the flex panel 44, which is intermediate and adjacent the support wheels 26. As is described below, the attached, perforated baffles 52 provide an enhanced flow of water between pairs of adjoining support wheels 26.

A second of the planar surfaces of the perforated baffle 52, a rear deflector plate 86, extends from the initial deflector bend 82 to an apex bend 88, which initiates a third planar surface, an inclined attack plate 94. A linear arrangement of ports 98 are formed in the attack plate 94 of sufficient diameter to enable a stream of water to flow through during operation of the vacuum head 10.

The hose connector support panel 54 is differently configured than are the flex panels 44 just described, and a modification in the perforated baffle 52 is required for attachment. A web stiffener 104 is formed in an upper surface of the connector support panel 54 and extends laterally, parallel to but separated from the front edge 18 of the flat body 14. A support bracket 108 is formed in the support plate 74 of dimensions suitable for being received by the web stiffener 104. A pair of support bracket fasteners 112 are used to attach and retain the support bracket 108 to/on the web stiffener 104, with a corresponding pair of fastener apertures 114 formed in the web stiffener for receipt of the bracket fasteners 112.

To further retain the perforated baffles 52 in position on the flex panels 44 a cooperative interaction between the axle caps 28 and the weight housing outer cap 58 is utilized, as is best described with reference to FIG. 3. As discussed, the support plate 74 is received by the support walls 62, utilizing the receiving slots 76, enabling the outer cap 58 to exert a downward pressure on the perforated baffle 52. The rear deflector plate 86 and the inclined attack plate 94 form an angle relative to one-another extending from the apex bend 88.

Placement of this angled structure and the apex bend 88 upon the adjacent pair of axle caps 28 results in a downward, biasing force exerted against the axle caps 28 by the perforated baffle 52. Removal of the perforated baffle 52 requires pushing the apex bend 88 away from the axle caps 28 which increases the biasing force applied by the perforated baffle 52. In this manner the force applied by the perforated baffle 52 against the axle caps 28 seeks to maintain the perforated baffle properly positioned with the support plate resting on the flex panel 44 and the rear deflector plate 88 and the included attack plate 94 pressing against the axle caps 28.

Figure 3:
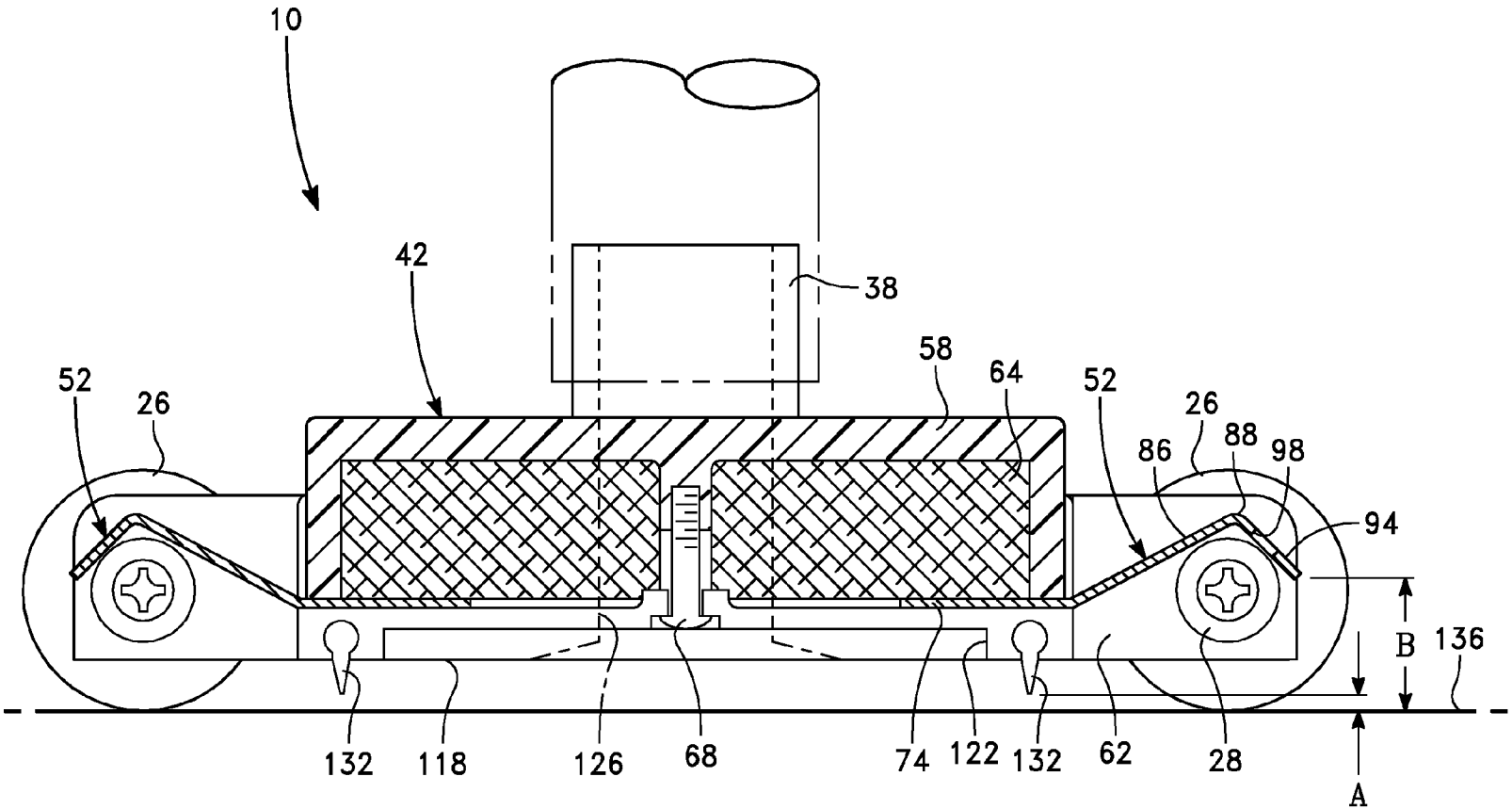
FIG. 3 is a side elevation view, in cross-section taken along line 3-3 of FIG. 1, with portions shown in phantom, of a vacuum head in accordance with the present invention.

Also shown in FIG. 3 is a vacuum head bottom surface 118 having a centrally-located collector recess 122 formed therein. Centered within the collector recess 122 is a suction port 126 through which water flow is directed towards the vacuum hose connector 38. A pair of seal members 132 extend the width of the flat body 14 along both the front are rear edges 18, 22 thereof.

When the vacuum head 10 is placed upon a pool surface 136, the seal members 132 extend from the bottom surface 118 of the vacuum head 10 either entirely to the pool surface 136, resulting in no gap—termed a "long leg" seal, or, as is shown in FIG. 3, an insufficient length to reach the pool surface 136 ("short leg" seal), resulting in a gap of distance A—which is preferably a distance of 3/16 of an inch or less. It is through this gap A that leaves and other low density debris must pass as they become entrained in the water flowing into the vacuum head 10, for discharge through the vacuum hose connector 38. When the perforated baffles 52 are in place, the distance between the lowest extent of the inclined attack plate 94 and the pool surface 136 is shown as gap B in FIG. 3, a distance of preferably 11/16 of an inch to 3/4 of an inch.

Figure 4:
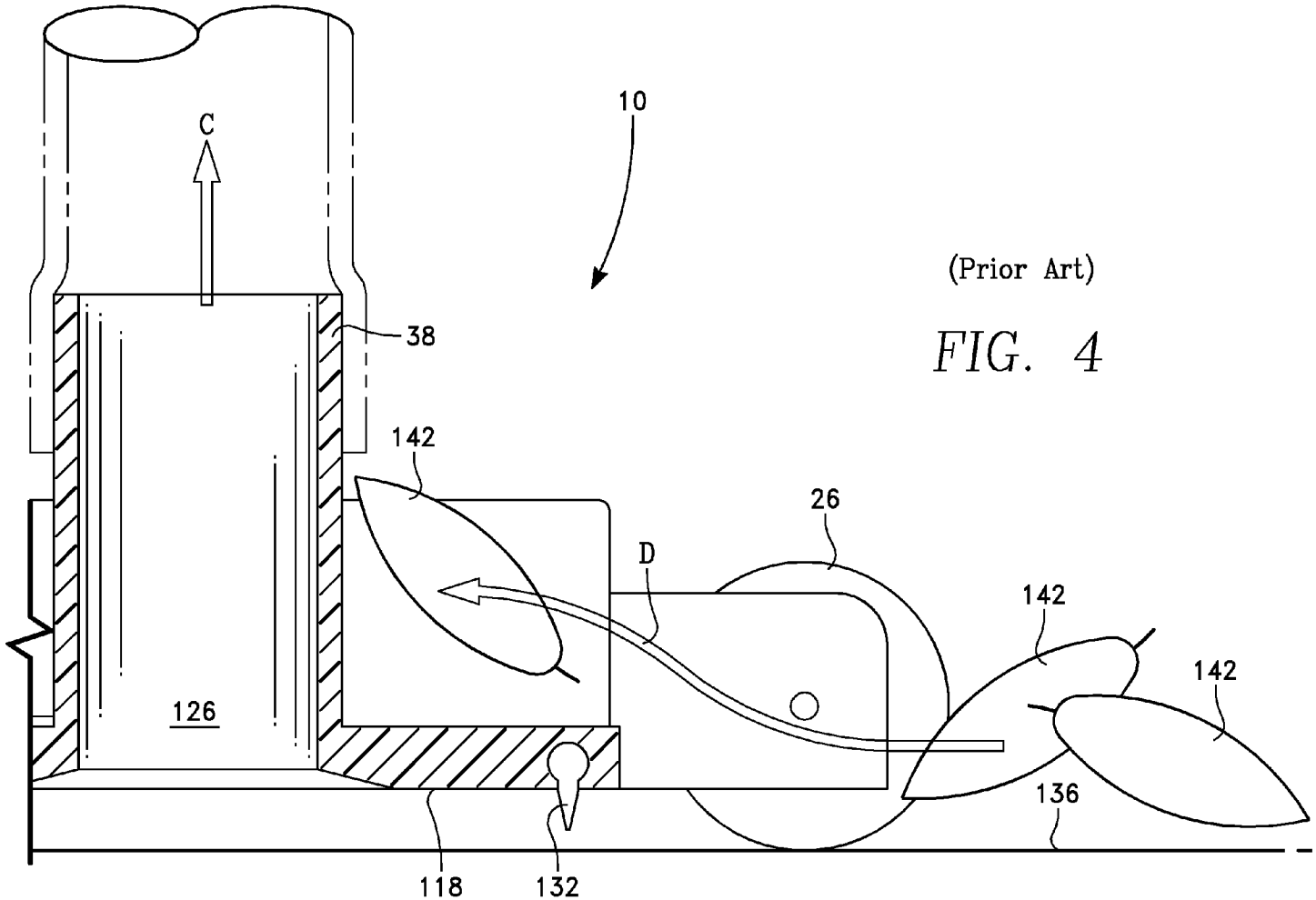
(Prior Art) FIG. 4
FIG. 4 is a partial side elevation view, in cross-section and with portions shown in phantom, schematically depicting the flow of water and entrained leaves obtained using a prior art vacuum head.

The results obtained through use of the perforated baffles 52 is best understood by first reviewing the entrainment problem encountered using the prior art vacuum head—as shown in FIG. 4. The evacuation of water from the vacuum head 10 through the vacuum hose connector 38, depicted as flow arrow C, generates a flow of water from the surrounding pool towards the vacuum head 10. Entry of the water is restricted to the gap under the seal members 132 and at the openings at each lateral edge of the flat body 14 (see FIGS. 1 and 2).

Thus, while water flows through these openings, the restricted openings do not permit entry of all of the water flowing towards the vacuum head 10. Such diverted exterior water flow is depicted by flow arrow D. For larger, low density debris, such as a plurality of leaves 142 shown adjacent the vacuum head 10, the restricted openings make passage difficult, with a tendency for many of the leaves 142 to flow over and outside of the vacuum head 10, requiring repeated passes in order to be entrained in the water represented by flow arrow C for capture.

Figure 5:
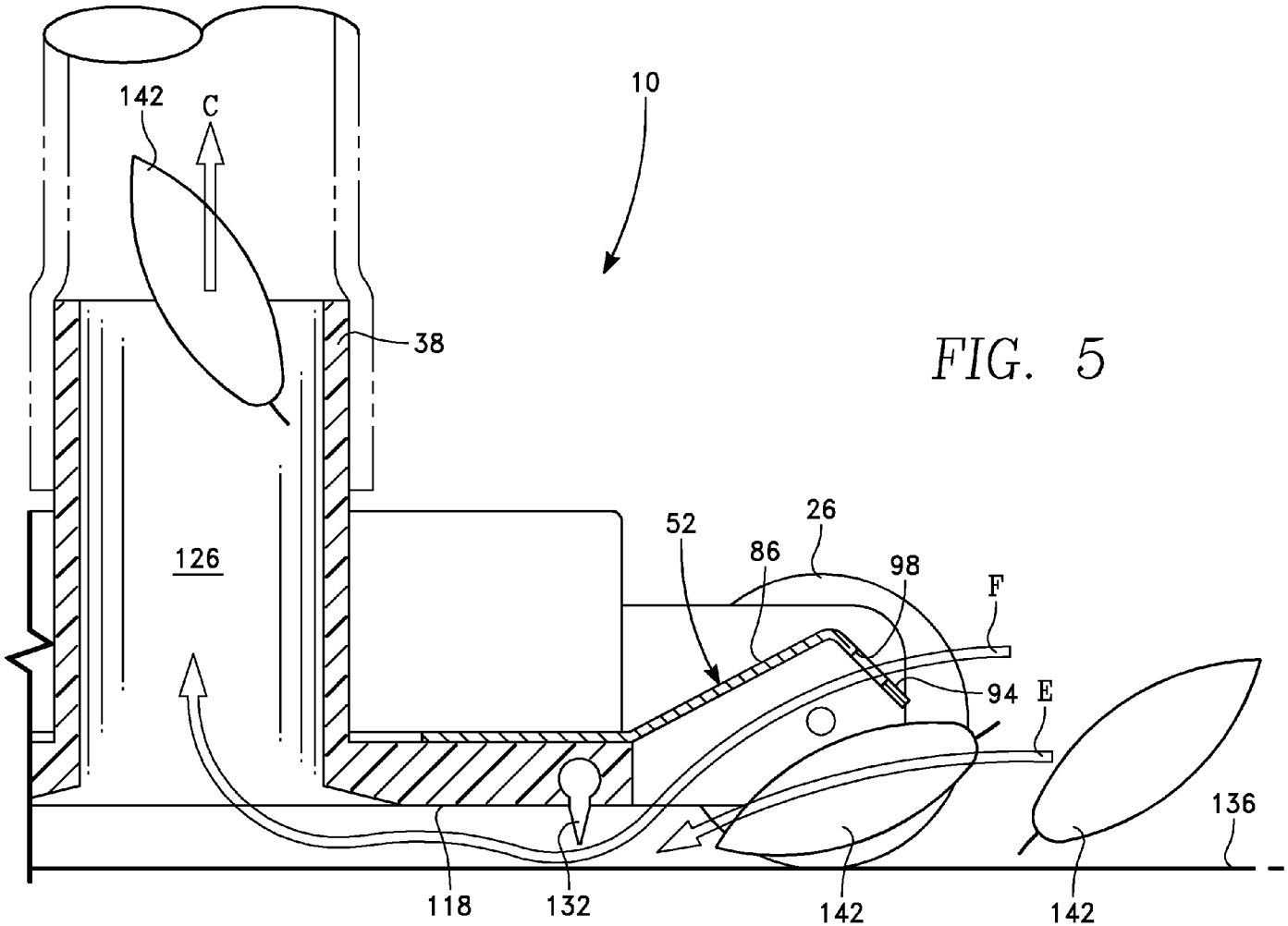
FIG. 5 is a partial side elevation view, in cross-section and with portions shown in phantom, similar to FIG. 4, schematically depicting the flow of water and entrained leaves obtained using a vacuum head in accordance with the present invention.

The capturing efficiencies obtained through use of the perforated baffles 52 are illustrated by FIG. 5. The raised profile of the rear deflector plate 86 provides a larger opening to capture leaves and other low density debris (such as pine needles and flower petals). Additionally, the rear deflector plate 86 reduces the tendency of the flowing water to be displaced up and over the vacuum head 10 (as exemplified by flow arrow D in FIG. 4); instead being directed downward, as depicted by flow arrow E.

A third beneficial entrainment enhancement is obtained as a result of the profile presented by the initial portion of the perforated baffle 52—the inclined attack plate 94. As positioned essentially cross-wise to the flow of water, the position of the inclined attack plate 94 is thought to result in an enhanced water pressure profile in the immediate area of inclined attack plate 94. This pressure imbalance is relieved by the inducement of a fast flow of water—directed currents or a channeling effect, through the plurality of ports 98 formed therein. Such enhanced flow currents, as depicted by flow arrow F, downwardly direct the leaves and other low density debris, flattening and pushing them through the gap formed under the seal members 132. Such channeled currents are thought to greatly expedite the entrainment and disposal of low density debris, as is depicted by flow arrow C inside the vacuum hose connector 38.

In a preferred embodiment the vacuum head 10 is a Pentair Model No. 214, which is offered at wholesale and retail pool maintenance and supply outlets nationwide and over the Internet. The perforated baffles 52 are preferably fabricated out of ABS plastic, although they may also be fabricated out of stainless steel. If plastic, than molded to the appropriate dimensions (discussed hereinafter); and if steel, initially a rectangular/square piece of metal measuring 2 3/4 inches in length, 2 9/16 inches in width, and having a thickness of 0.045 inches. The receiving slots 76 are formed in the support plate 74, and each measure approximately 1 and 3/16 inches in length and 3/16ths of an inch in width, with each slot located 11/16 of an inch from the adjacent lateral edge, and with a separation between the two slots of approximately 27/32 of an inch. The initial deflector bend 82 is located approximately 1 1/8 inches from the back edge 78 of the support plate 74, which defines the initial portion of the rear deflector plate 86, which is at an angle of approximately 25 degrees with respect to the support plate 74.

The rear deflector plate 86 extends approximately 1 1/16 inches, ending at the apex bend 88, with the inclined attack plate 94 bent downward approximately 80 degrees from the plane of the rear deflector plate 86. The inclined attack plate 94 extends another 9/16 of an inch beyond the apex bend 88. Five (5) ports 98 are preferably formed in and equally spaced across the width of the inclined attack plate 94. Each of the ports 98 are preferably 11/64 of an inch in diameter, with a spacing of approximately 15/32 of an inch (center-to-center basis).

As discussed previously, the perforated baffle 52 used with the hose connector support panel 54 has a different support plate to accommodate a different manner of attachment to the vacuum head 10 utilizing the web stiffener 104. The distance between the initial deflector bend 82 and the support bracket 108 measures 5/8 of an inch, with the support bracket 108 extending vertically a distance of 9/16 of an inch and terminating in a hook portion that conforms to the dimensions of the upper terminus of the web stiffener 104, upon which it is received. The support bracket fasteners 112 are appropriately #6 by 1/4 inch stainless panhead screws, and are preferably separated a distance of approximately 1 1/2 inches.

My invention has been disclosed in terms of a preferred embodiment thereof, which provides leaf collection traps for pool vacuums that is of great novelty and utility. Various changes, modifications, and alterations in the teachings of the present invention may be contemplated by those skilled in the art without departing from the intended spirit and scope thereof. It is intended that the present invention encompass such changes and modifications.

I claim:

1. A water flow enhancement guide for a pool and spa vacuum head, the vacuum head having an elongate unitary flexible body having a substantially flat bottom surface and lengthwise front and rear edges extending along a width of the body, a plurality of support wheels carried by the body forwardly of the front and rearward of the rear body edges, adjacent pairs of support wheels separated and defining an open segment along said front and rear body edges, said open segment corresponding to a flex panel formed in the body, and a suction port through the body substantially centrally of the length and width thereof, and including means carried on an upper body surface for connecting a pool water suction line to the suction port, said water flow enhancement guide comprising:

a baffle having a first end adapted to be received by the open segment of the body and mate with the flex panel of the body, and a second end displaced in an angle.

2. A water flow enhancement guide as described in claim 1, wherein said inclined attack plate has a plurality of apertures formed therein.

3. A water flow enhancement guide as described in claim 2, wherein said plurality of apertures comprise a linear arrangement of ports.

4. A water flow enhancement guide as described in claim 3, the vacuum head having a pair of support walls that are attached to and extend from a plurality of said flex panels, said support walls are arranged in parallel relation and extend substantially perpendicularly to said front and said rear body edges, wherein said first end of said baffle has a pair of receiving slots formed therein, said receiving slots adapted to be received by and interengage with said pair of support walls of the flex panel.

5. A water flow enhancement guide as described in claim 4, the vacuum head having an outer cap received by and secured to the pair of support walls, defining a weight housing, wherein said receiving slots are each adapted to be received at a base of a respective one of said pair of support walls and adapted to be secured to said flex panel upon securement of said outer cap to said support walls.

6. A water flow enhancement guide as described in claim 5, the vacuum head having a pair of axle caps attached to each of the support wheels, wherein upon securement of said first end to said flex panel the first angle displacement in said second end of said baffle is adapted to bias the rear deflector plate and the inclined attack plate of said second end against adjacent ones of said pairs of axle caps.

7. A water flow enhancement guide as described in claim 4, the suction port of the vacuum head formed in a hose connector support panel extending between adjacent pairs of support walls, a web stiffener attached to and projecting from the hose connector support panel, aligned substantially parallel to and spaced from the front edge of the body, and further comprising a modified baffle having a modified first end defining a support bracket adapted to be received by said web stiffener.

8. A water flow enhancement guide as described in claim 7, the web stiffener having a pair of fastener apertures formed therein, wherein said support bracket of said modified baffle is provided a pair of fastener apertures adapted to conform in dimension and location to said pair of fastener apertures when said support bracket is received by said web stiffener.

9. A device to enhance the flow of water between support wheels of a vacuum head, the vacuum head having an elongate body with a bottom surface and front and rear edges, a plurality of the support wheels spaced apart along both the front and rear edges with a plurality of flex panels, each extending between an adjacent pair of support wheels, said device to enhance the flow of water comprising:

a baffle having three distinct planar surfaces, said first planar surface comprising a support plate adapted to attach to an open segment of the flex panel, said open segment adjacent either said front or said rear edge, said second planar surface comprises a rear deflector plate and extends from an initial deflector bend adjacent said support plate to an apex bend, and said third planar surface comprises an inclined attack plate and extends from said apex bend to a terminus of said baffle.

10. A device to enhance the flow of water as defined claim 9, wherein said inclined attack plate has a plurality of apertures formed therein.

11. A device to enhance the flow of water as defined in claim 10, wherein said plurality of apertures comprise a linear arrangement of ports.

* * * * *